US010039680B2

(12) United States Patent
Galbraith

(10) Patent No.: US 10,039,680 B2
(45) Date of Patent: Aug. 7, 2018

(54) BODY SLING AND PATIENT HANDLING SHEETS

(71) Applicant: Nurses Care, LLC, Olympia, WA (US)

(72) Inventor: Myriam Galbraith, Olympia, WA (US)

(73) Assignee: Nurses Care, LLC, Olympia, WA (US)

( * ) Notice: Subject to any disclaimer, the term of this patent is extended or adjusted under 35 U.S.C. 154(b) by 464 days.

(21) Appl. No.: 14/924,067

(22) Filed: Oct. 27, 2015

(65) Prior Publication Data

US 2016/0374883 A1 Dec. 29, 2016

Related U.S. Application Data

(60) Provisional application No. 62/068,969, filed on Oct. 27, 2014.

(51) Int. Cl.
*A61G 7/10* (2006.01)

(52) U.S. Cl.
CPC ..... *A61G 7/1051* (2013.01); *A61G 7/1055* (2013.01); *A61G 7/1073* (2013.01); *A61G 7/1061* (2013.01)

(58) Field of Classification Search
CPC .. A61G 7/1026; A61G 2200/32; A61G 7/103; A61G 1/01; A61G 7/001; A61G 7/1023; A61G 7/1051; A61G 7/1073; A61G 7/1055
See application file for complete search history.

(56) References Cited

U.S. PATENT DOCUMENTS

| | | | | |
|---|---|---|---|---|
| 633,111 | A | 9/1899 | Bartlett | |
| 3,829,914 | A * | 8/1974 | Treat | A47C 21/00 5/495 |
| 4,675,925 | A * | 6/1987 | Littleton | A61G 7/1026 5/484 |
| 4,689,842 | A | 9/1987 | Kuhn | |
| 5,860,174 | A | 1/1999 | Failor | |
| 5,901,388 | A | 5/1999 | Cowan | |
| 6,772,764 | B2 | 8/2004 | Chapman | |
| 8,161,583 | B1 * | 4/2012 | Palen | A61G 7/001 5/81.1 HS |
| 2006/0037136 | A1 | 2/2006 | Weedling et al. | |
| 2008/0028516 | A1 * | 2/2008 | Morishima | A61G 7/1051 5/89.1 |
| 2016/0095777 | A1 * | 4/2016 | Berman | A61G 7/1051 5/81.1 T |

* cited by examiner

*Primary Examiner* — Eric J Kurilla

(57) ABSTRACT

A body sling with patient handling sheets allowing a single caregiver to provide perineal care and skin integrity assessment to a bedridden patient, and further providing the capability to lift, turn, and reposition the patient with the use and aid of a patient lift.

13 Claims, 9 Drawing Sheets

BODY SLING AND PATIENT HANDLING SHEETS

CROSS-REFERENCE TO RELATED APPLICATIONS

This application claims the benefit of U.S. Provisional Patent Application No. 62/068,969, filed Oct. 27, 2014, which is incorporated herein by reference in its entirety.

BACKGROUND

1. Field of the Invention

This disclosure relates to embodiments for providing perineal care, including assessment of skin integrity to a bedridden patient. More particularly, the present embodiments relate to providing access for the single caregiver to provide the bedridden patient perineal care and timely skin integrity assessment, and further providing the single caregiver the capability of lifting, turning, and transferring patients with the aid of a patient lift.

2. Description of the Related Art

Immediate perineal care and skin integrity assessment are a necessity for any bedridden patient. Perineal care is performed after a bedridden patient uses the bedpan, becomes incontinent, or as part of daily bathing. During the facilitation of perineal care, the caregiver is able to observe the patient's perineal area for signs of skin breakdown, infection, skin excoriation, lesions or redness. Such care is required to be performed properly and regularly in order to reduce the risk of pressure sores, infections, or septicemia.

Further to avoid the formation of bed sores by providing the caregiver timely access to the perineal area, specially developed bed sheets and patient lifts are used to facilitate the frequent repositioning of bedridden patients. Ideally, a single caregiver, with the aid of a patient lift and rated sheets for lifting up to 1,100 pounds can reposition most any patient in bed, as well as turn the patient with minimal physical effort.

As safe patient handling regulations continue to be legislated, there is need for a body sling with patient handling sheets that may be used with the aid of a patient lift to provide perineal access and skin integrity assessment for a single caregiver while helping to maintain the caregiver's safety, avoiding caregiver injury, and reducing facility cost and liability.

SUMMARY

The present disclosure provides a body sling with patient handling sheets allowing a single caregiver to provide perineal care and skin integrity assessment to a bedridden patient, and further providing the capability to lift, turn, and reposition the patient with the use and aid of a patient lift.

In an embodiment of the present disclosure, a body sling intended to be used in combination with a patient lift, allows a single caregiver to provide perineal care and skin integrity assessment to a bedridden patient. The non-limiting, body sling includes a bottom sheet having two longitudinal sides; a plurality of elongated bottom sheet lift straps, each lift strap attached to the bottom sheet at a proximal end of each strap; and, a plurality of bottom sheet lift loops, each lift loop configured to attach on a distal end of each of the bottom sheet lift straps. The non-limiting, body sling includes a top sheet having two longitudinal sides; a plurality of elongated top sheet lift straps, each lift strap attached to the top sheet at a proximal end of each strap; and, a plurality of top sheet lift loops, each lift loop configured to attach on a distal end of each of the top sheet lift straps. The non-limiting body sling includes a cut-out in the shape of a rectangle positioned in the top sheet, providing a window and allowing access to a perineal area of the patient.

In an embodiment of the present disclosure, a method for allowing a single caregiver to provide perineal care and skin integrity assessment to a bedridden patient, the method to be used in combination with a patient lift includes, laying a bottom sheet flat and symmetrically across a mattress; extending a plurality of bottom sheet lift straps away and down from the mattress; laying a top sheet flat and symmetrically across the bottom sheet; aligning a plurality of top sheet lift straps to be interspersed between the plurality of bottom sheet lift straps; aligning fastening strips between the bottom sheet and the top sheet; positioning the patient on top of the top sheet; securing the bottom sheet lift straps and a plurality of complimentary bottom sheet lift loops on one side of the mattress to the patient lift; securing the top sheet lift straps and a plurality of complimentary top sheet lift loops located on the one side of the mattress of the aforementioned step to the patient lift; detaching the fastening strips from one another to expose a cut-out in the top sheet; and, gaining access to a perineal area of the patient.

It should be understood that the summary above is provided to introduce in simplified form a selection of examples that are further described in the detailed description. It is not meant to identify key or essential features of any claimed subject matter that may later claim priority to the present description. Furthermore, the scope of any such claimed subject matter would not be limited to implementations that solve any disadvantages noted above or herein contained.

BRIEF DESCRIPTION OF THE DRAWINGS

Many aspects of the present invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
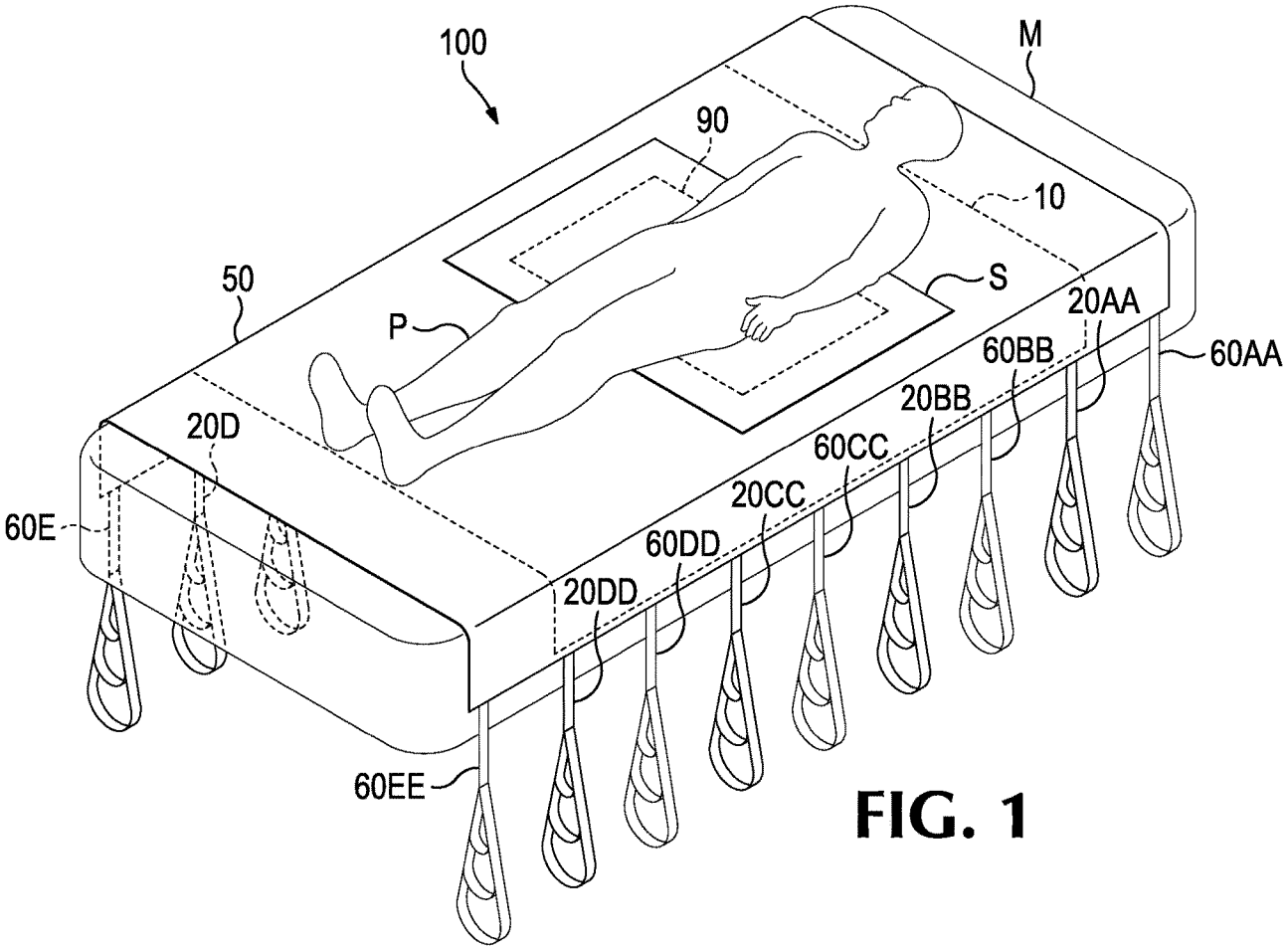
FIG. 1 is a top, front perspective view of an example of a body sling with patient handling sheets according to embodiments of the invention.

The embodiments in this disclosure, as illustrated in FIGS. 1 through 9 and described in the text below, are adapted for use in hospitals, skilled nursing facilities, and assisted living facilities, and for health and personal care in the patient's home or retirement community Referring to the drawings, wherein like reference numerals represent like parts throughout the various drawing figures, FIG. 1 is directed to a body sling 100 with patient handling sheets 10, 50. The sling 100 is made up of two handling sheets 10, 50, a bottom sheet 10 and a top sheet 50. In addition, the bottom sheet 10 includes lift straps 20. There are eight total bottom sheet lift straps 20, arranged with four straps 20 positioned on each longitudinal side of the bottom sheet 10. Also included with the bottom sheet 10, are lift loops 30 (left side) and 40 (right side). There are three (A, B, C) loops 30, 40 per strap 20. Still further, the sling 100 includes the top sheet 50, which has ten top sheet lift straps 60 (five per side) and three (A, B, C) lift loops 70, 80, per strap 60. The top sheet 50 also includes a cut-out 90 in the shape of a rectangle positioned in the middle to top region of the sheet 50. The cut-out 90 provides a window and access to the perineal area of the patient P. Also, as shown in FIG. 1, included are the sanitary pad S and mattress M.

Figure 2:
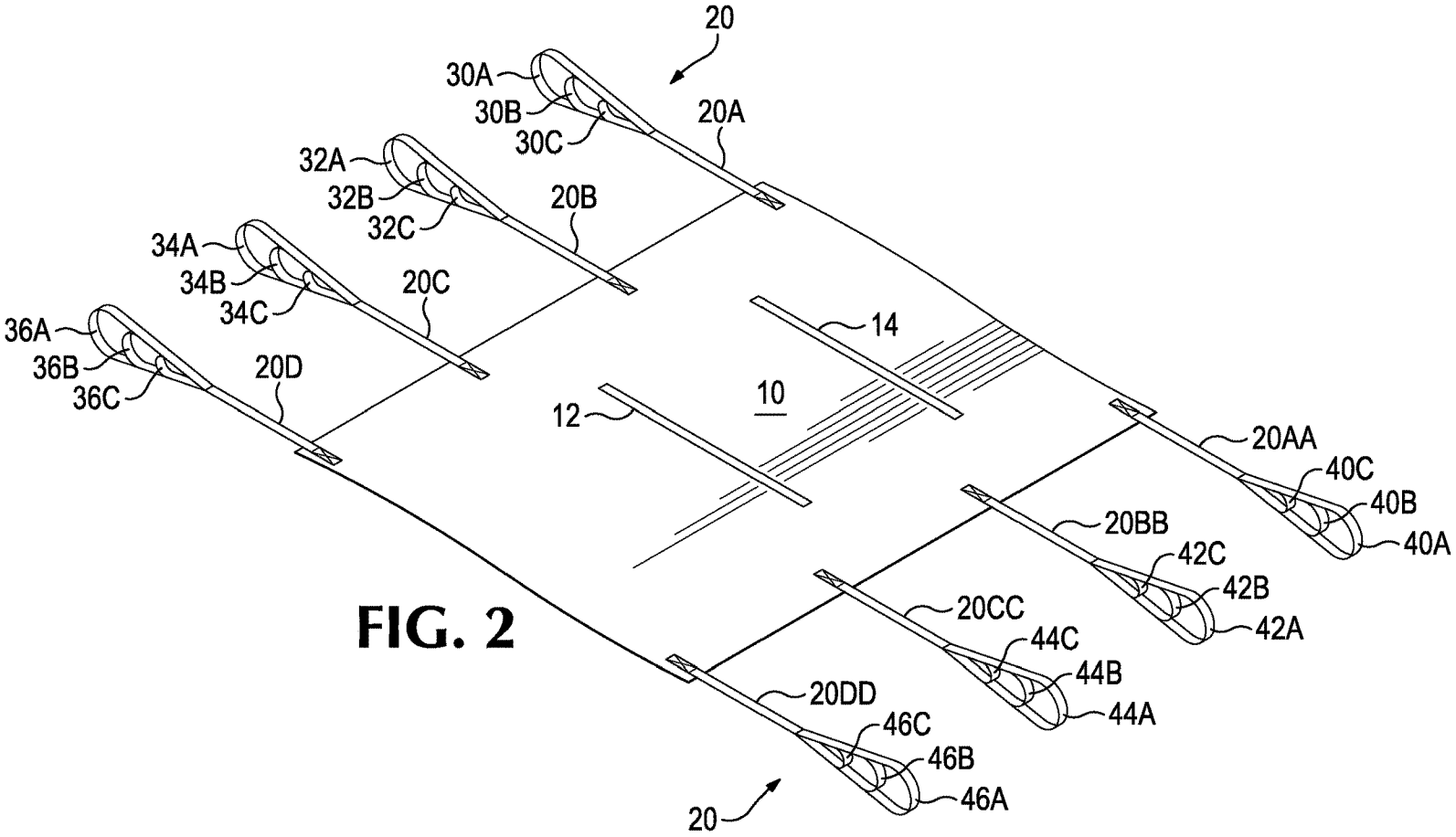
FIG. 2 is a top perspective view of the bottom sheet shown in FIG. 1.

Referring to FIG. 2 and with continuing reference to FIG. 1, bottom sheet 10 is an industry-type sheet 10 with a length of about three feet and a width of about three feet, ten inches. It should be understood that different lengths and widths are contemplated while different dimensioned sheets may be necessary to compensate for different sized mattresses M and patients P. The straps 20 are positioned on opposite sides from one another, four (20A-20D and 20AA-20DD) on each side. The straps 20 are attached and sewn to the bottom sheet 10 on the upper surface A of the bottom sheet 10. The straps 20 are evenly spaced apart along the length of the bottom sheet 10 and each strap 20 terminates in a three loop 30, 40 configuration. Each loop 30, 40 corresponds to a complimentary strap 20. As illustrated in FIG. 2, on the left side of bottom sheet 10, strap 20A terminates in loop 30 A, B, C; strap 20B terminates in loop 32 A, B, C; strap 20C terminates in loop 34 A, B, C; and so on resulting in four straps 20 on each side, each strap 20 having three loops 30 (left side). The same complimentary configuration is used for the right side of the sheet 10, as strap 20AA terminates in loop 40 A, B, C, and so on. The straps 20 and loops 30, 40 may be color-coded to help distinguish from the top sheet's 50 configuration.

Figure 3:
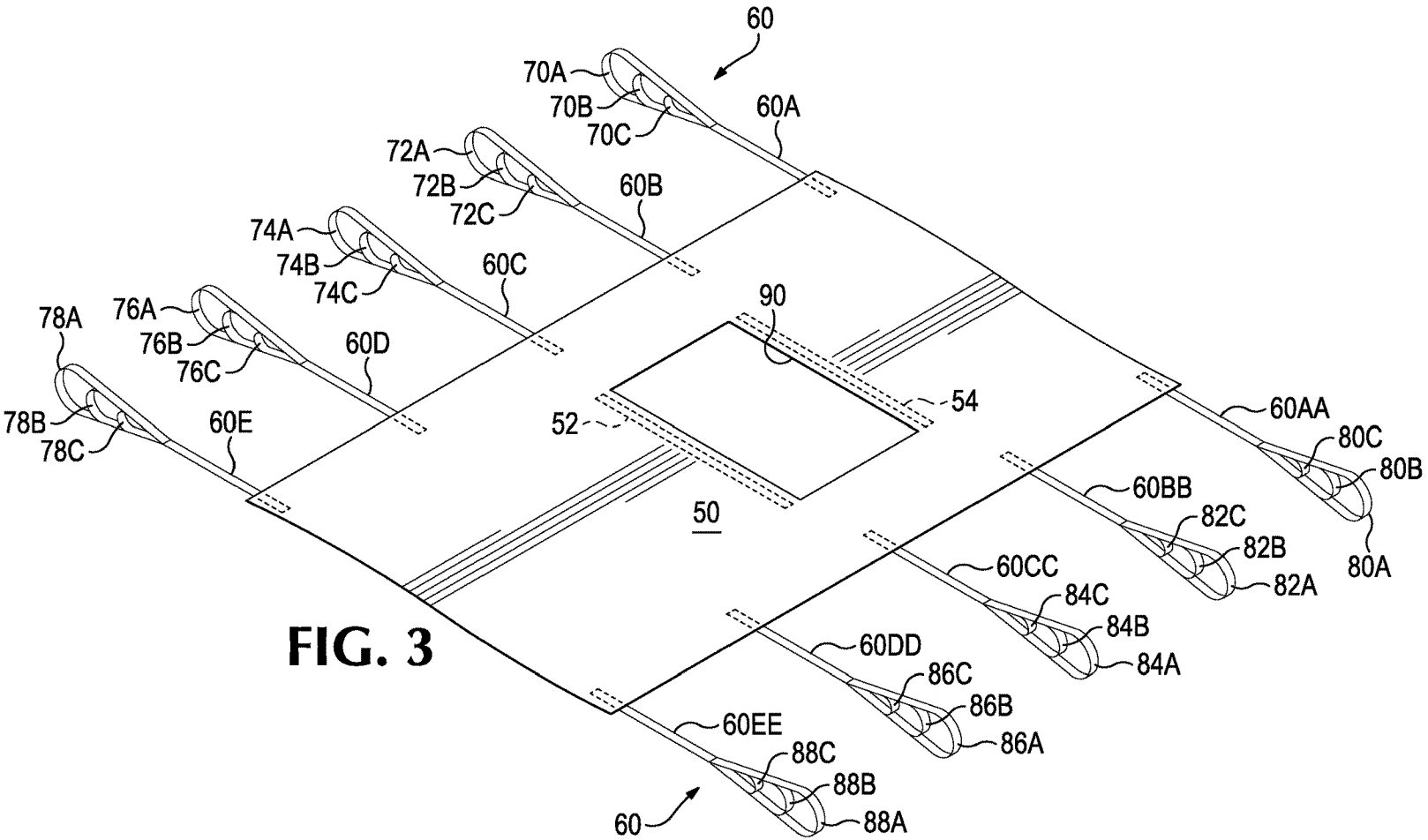
FIG. 3 is a top perspective view of the top sheet shown in FIG. 1.

Still referring to FIG. 2, fabric hook and loop type fastening strips 12 and 14 are shown. The corresponding sections to be mated with fastening strips 12 and 14 are shown in FIG. 3 (to be described below) and identified by reference numeral labels 52 and 54. The fastening strips 12 and 14, as well as complimentary strips 52 and 54 can be any known type of fabric hook and loop fastener or the like commonly used to adhere various fabrics together; thus, preventing the sheets 10 and 50 from slipping out of alignment and configuration with one another. The strips (12, 14, 52, 54) should be durable and washable, but not bulky so as to avoid patient P bed sores.

Referring to FIG. 3 and with continuing reference to FIG. 1, top sheet 50 is an industry-type sheet with a length of about six feet, four inches and a width of about three feet, ten inches. It should be understood that different lengths and widths are contemplated while different dimensioned sheets may be necessary to compensate for different sized mattresses M, patients P, and complimentary bottom sheets 10. The top sheet 50 lift straps 60 are positioned on opposite sides from one another, five (60A-60E and 60AA-60EE) on each side. The straps 60 are attached and sewn to the top sheet 50 on the lower surface (not shown) of the top sheet 50. The straps 60 are evenly spaced apart along the length of the bottom sheet 50 and each strap 60 terminates in a three loop 70, 80 configuration. Each loop 70, 80 corresponds to a complimentary strap 60.

As illustrated in FIG. 3, on the left side of top sheet 50, strap 60A terminates in loop 70 A, B, C; strap 60B terminates in loop 72 A, B, C; strap 60C terminates in loop 74 A, B, C; and so on resulting in five straps 60 on each side, each strap 60 having three loops 70 (left side). The same complimentary configuration is used for the right side of the sheet 50, as strap 60AA terminates in loop 80 A, B, C, and so on. The top sheet 50 straps 60 and loops 70, 80 may be color-coded in a different color from the bottom sheet 10 straps 20 and loops 30, 40 to help distinguish from the bottom sheet's 10 configuration. As noted above, top sheet 50 includes fabric hook and loop type complimentary strips 52 and 54 on the underside of top sheet 50 for mating to strips 12 and 14 of bottom sheet 10.

The top sheet 50 further includes cut-out 90, as a window to the patient's P perineal area and to further provide the caregiver (not shown) access to the perineal area. It should be understood that different lengths and widths are contemplated for the cut-out 90 to accommodate for different dimensioned top sheets 50, which may be necessary to compensate for different sized mattresses M, patients P, and complimentary bottom sheets 10.

It should be understood by one of ordinary skill in the art that bottom sheet 10 and top sheet 50 can be constructed from any suitable material that is durable, washable, breathable, and rated to withstand loads of up to 1,100 pounds. Such materials include, by way of example, cotton, nylon, polyester, or blends thereof.

The straps 20 and 60 are constructed from any suitable material that it is rated to handle the suspension of a patient P on a ceiling lift, a hanger lift, or portable lift with a vertically adjustable beam, typically used for bedridden patients P. Such materials are known in the art and one example of a (partial) lift L is illustrated in FIGS. 6-9. The loops 30, 40 and 70, 80 of the handling sheets 10, 50 come in three sizes and orientations (A, B, C) relative to the sheets 10, 50 to providing a choice for the healthcare practitioner. Loops 30, 40 and 70, 80 are made from any suitable material that it is rated to handle the suspension of a patient P. Those of skill in the art will appreciate that any suitable material alternative and fastener alternative is contemplated as being within the spirit and scope of the invention.

Figure 4:
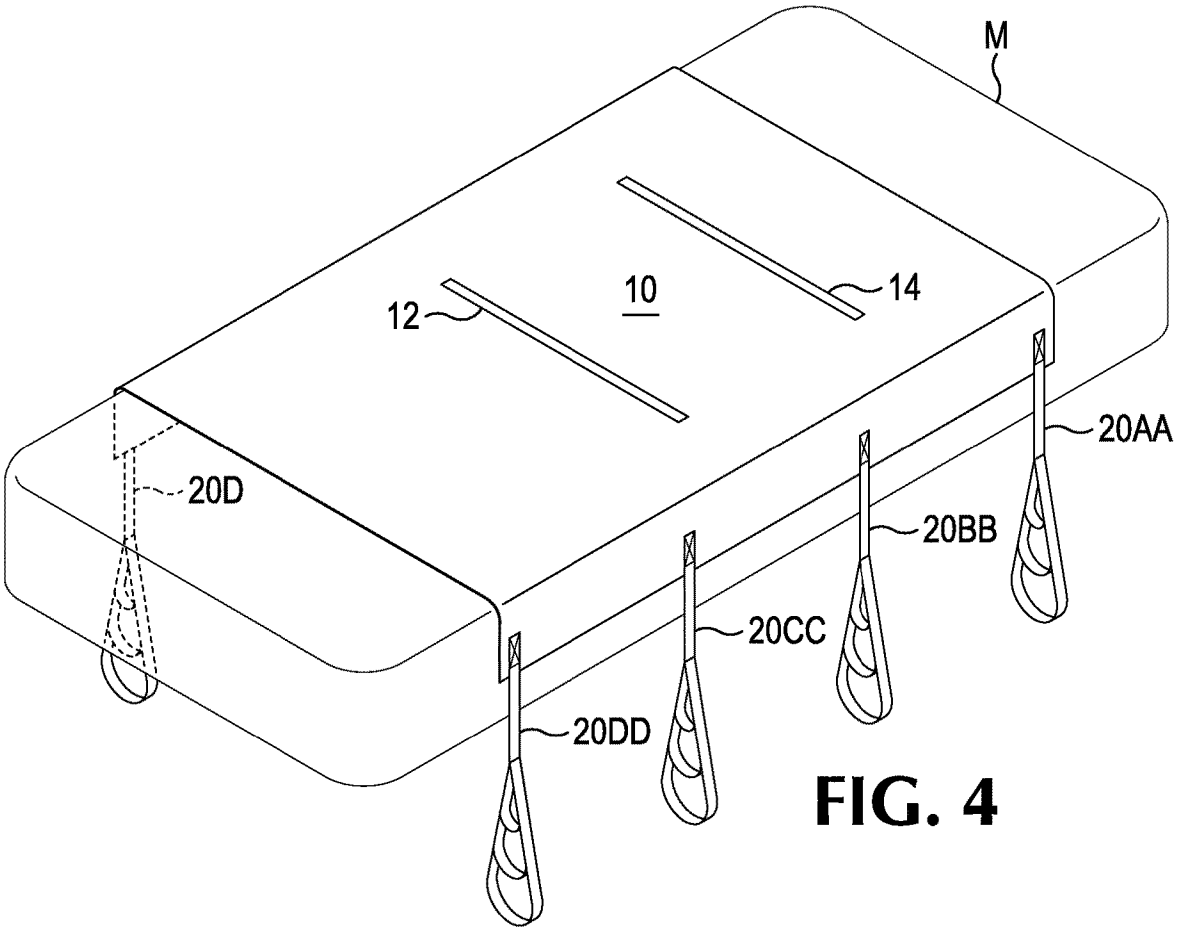
FIG. 4 is a top, front perspective view of the bottom sheet shown in FIG. 2 positioned on a mattress.
Figure 5:
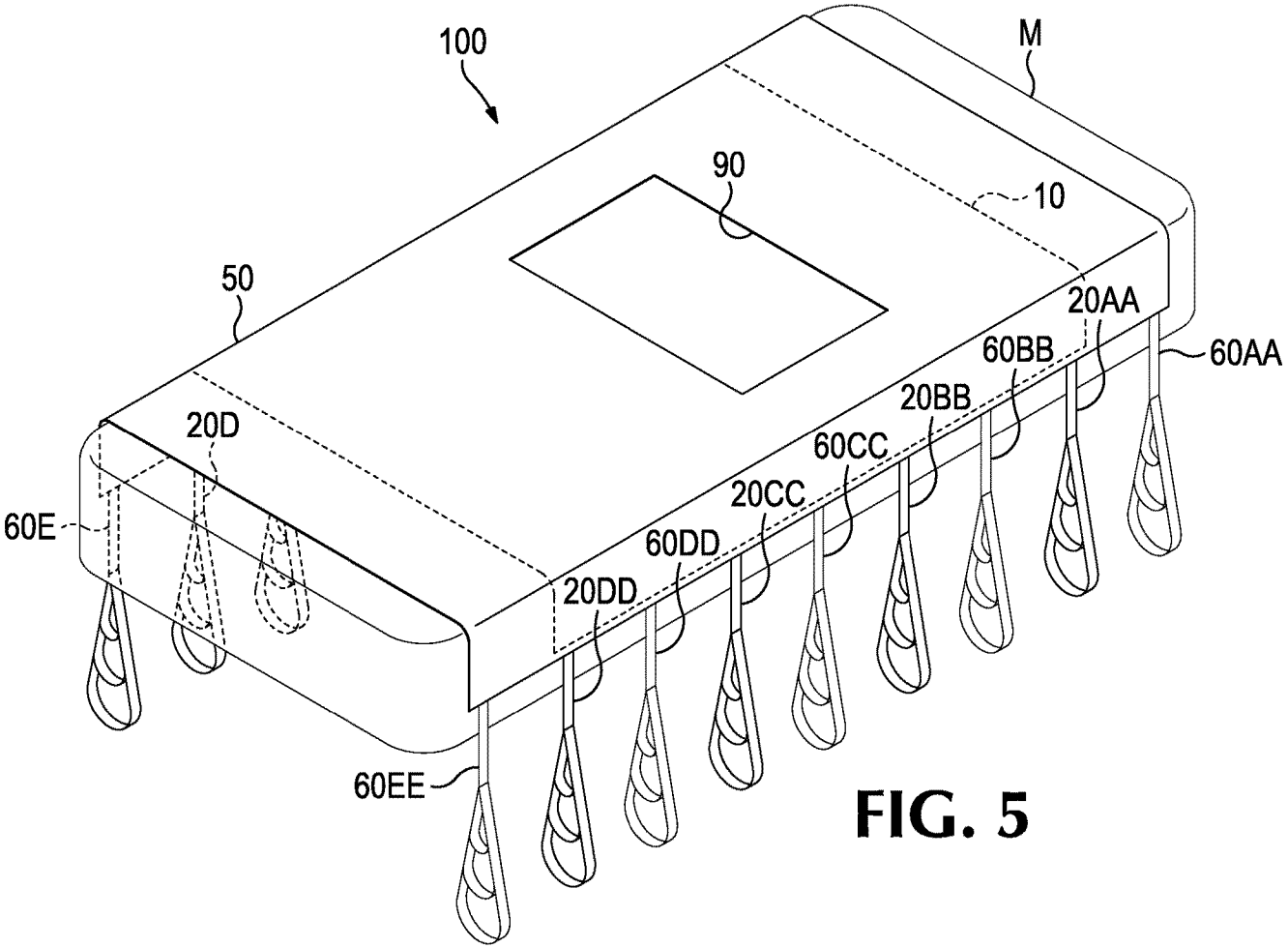
FIG. 5 is a top, front perspective view of both the bottom and the top sheets, as shown in FIGS. 2 and 3 positioned on a mattress.

Referring to FIGS. 4 and 5, the layout of the two sheets 10, 50 on the mattress M and sanitary pad S as placed on top of one another is shown. First, in the example shown in FIG. 4 the bottom sheet 10 is placed on the mattress M and the bottom sheet 10 straps 20 and loops 30, 40 are draped over the respective edges of the bed (not shown) and mattress M. Next, in the example shown in FIG. 5, the top sheet 50 is placed over the bottom sheet 10 on the mattress M. Each of the top sheet 50 straps 60 and loops 70, 80 is draped over each edge of the mattress M and aligned to be interspersed between the bottom sheet 10 straps 20 and loops 30, 40, accordingly. Further illustrated in FIG. 5, is the cut-out 90 which exposes the bottom sheet 10 underneath top sheet 50.

Figure 7:
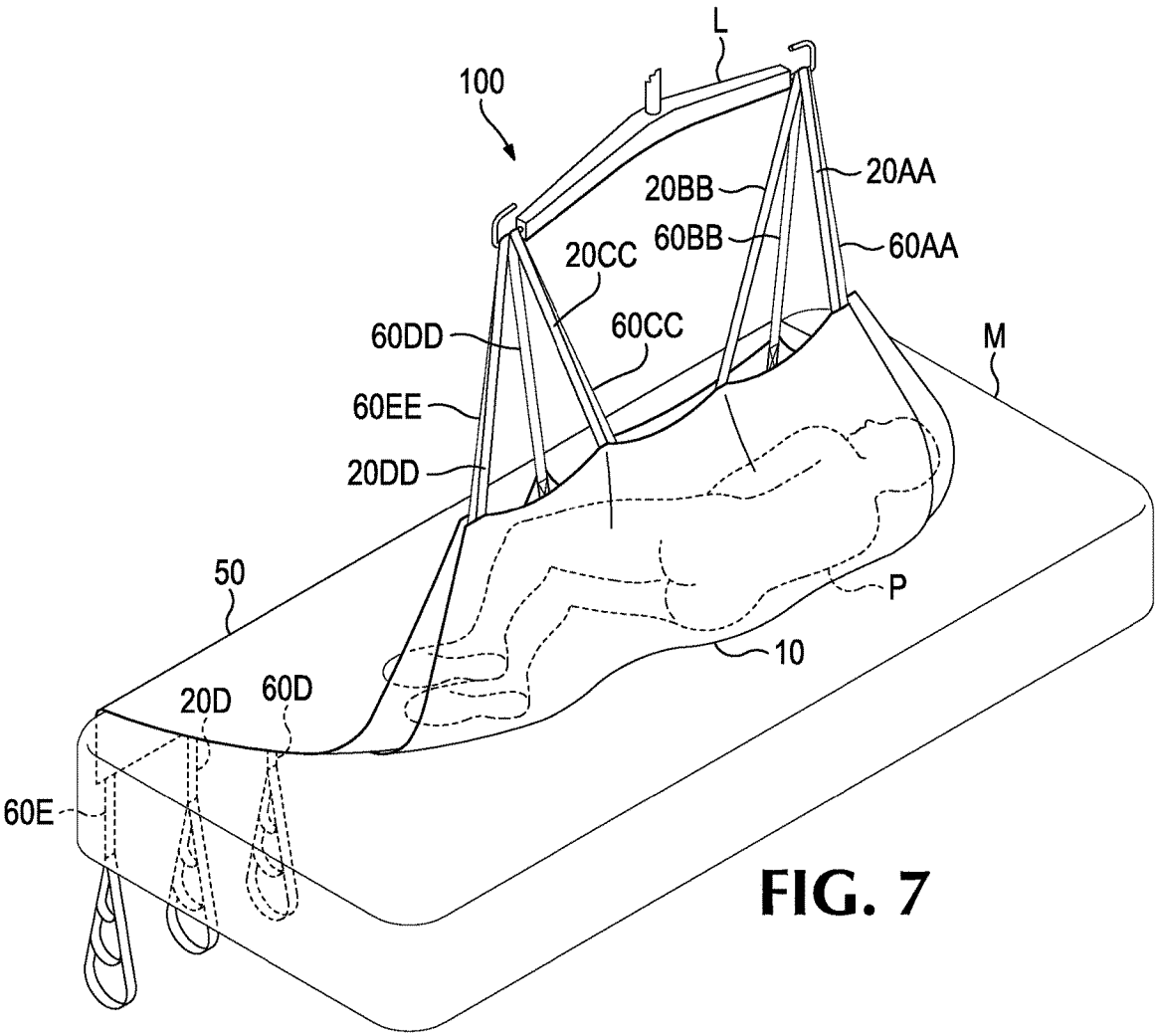
FIG. 7 is a top, front perspective view of an example of a body sling with patient handling sheets and a lift with the patient turned to one side, according to embodiments of the invention.
Figure 8:
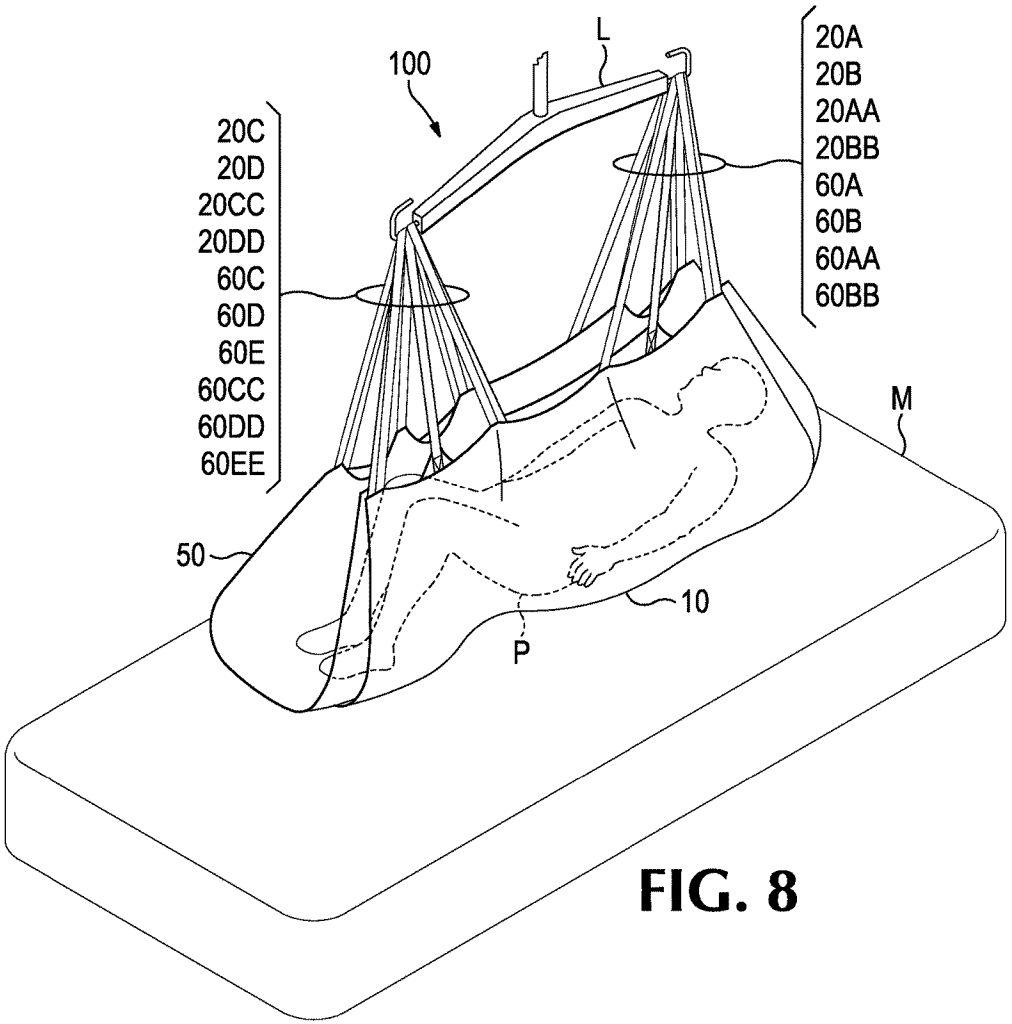
FIG. 8 is a top, front perspective view of an example of a body sling with patient handling sheets and a lift with the patient suspended above the mattress, according to embodiments of the invention.
Figure 9:
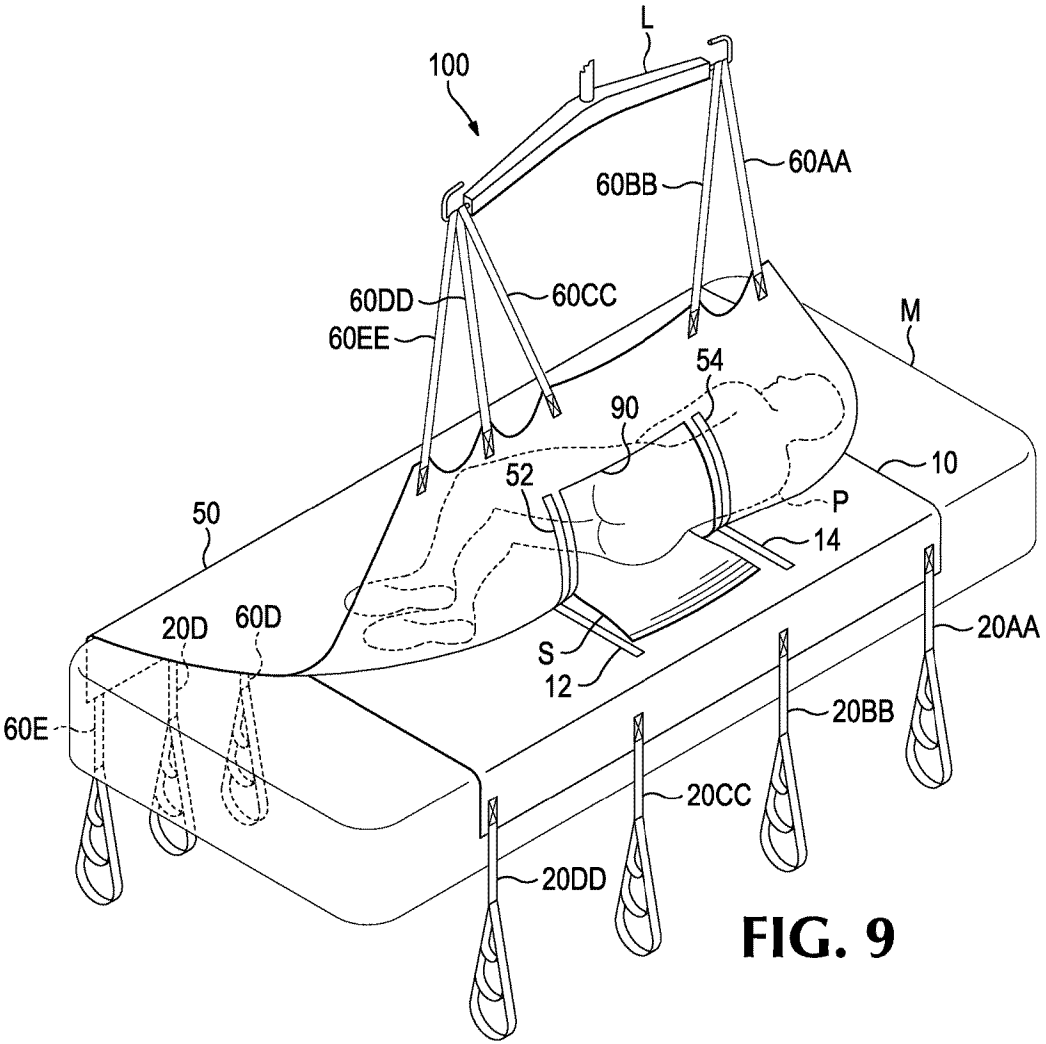
FIG. 9 is a top, front perspective view of an example of a body sling with patient handling sheets and a lift with the patient turned to one side providing access to the perineal area, according to embodiments of the invention.

As illustrated in FIGS. 6-9, perineal care may be provided by the health care practitioner (not shown) by way of access to cut-out 90. See FIG. 9. Patient P can be turned, repositioned, and fully suspended in the body sling 100. In one example, and with continuing reference to FIGS. 6-9, the bottom sheet 10 is first laid flat and symmetrically across the mattress M. All the straps 20 of the bottom sheet 10 are extended away and down from the sides of the mattress M. The top sheet 50 is then laid flat and symmetrically across the bottom sheet 10 with the fabric and loop type fastening strips 12, 14, 52, and 54 aligned and attached between the two handling sheets 10, 50. As mentioned above, the straps 20, 60 can be color-coded to aid the caregiver in the alignment. Then, a sanitary pad S or more than one pad S can be positioned over the cut-out 90. Any pad S known in the industry may be used. Next, the patient P can be lifted via a portable lift (not shown) to the mattress M and placed face-up, on top of the pad S and sheets 10, 50. The four right side straps 20AA-DD and complimentary loops 40 A, B, C; 42 A, B, C; 44 A, B, C; and 46 A, B, C of the bottom sheet 10 and the five right side straps 60AA-EE and complimentary loops 80A, B, C; 82 A, B, C; 84 A, B, C; 86 A, B, C; and 88 A, B, C of the top sheet 50 are secured to the lift L stationed near the patient P mattress. It should be understood by one of ordinary skill in the art that the caregiver may choose between each loop 40, 80 A, B, or C configuration or, instead, tie (not shown) each strap loosely around itself and the lift L hanger for a quick release of the sheets 10 or 50. In order to gain perineal access, as illustrated in FIG. 9, fastening strips 12, 14, 52, and 54 become detached from one another to expose the cut-out 90 in the top sheet 50. A window of access is provided to the patient's P perineal area, allowing the caregiver to clean and care for. When the specific anatomical side of the patient P has been cleaned, the lift L is lowered, the right side straps 20AA-DD and complimentary loops 40 A, B, C; 42 A, B, C; 44 A, B, C; and 46 A, B, C of the bottom sheet 10 and the five right side straps 60AA-EE and complimentary loops 80A, B, C; 82 A, B, C; 84 A, B, C; 86 A, B, C; and 88 A, B, C of the top sheet 50 are unsecured from the lift L. Then, the mirror image of the procedure can be performed from the left side, utilizing the left side straps 20A-D and complimentary loops 30 A, B, C; 32 A, B, C; 34 A, B, C; and 36 A, B, C of the bottom sheet 10 and the five right side straps 60A-E and complimentary loops 70A, B, C; 72 A, B, C; 74 A, B, C; 76 A, B, C; and 78 A, B, C of the top sheet 50.

In another example, and with continuing reference to FIG. 8, both sides of straps 20, 60 and loops 30, 40 and 70, 80 are attached to the lift L. The lift L can be operated to raise and suspend the patient who is cocooned within the handling sheets 10, 50, from the mattress M. If desired and if a portable lift (not shown), for example, is used, the patient P can then be transferred to a gurney or the like.

Figure 6:
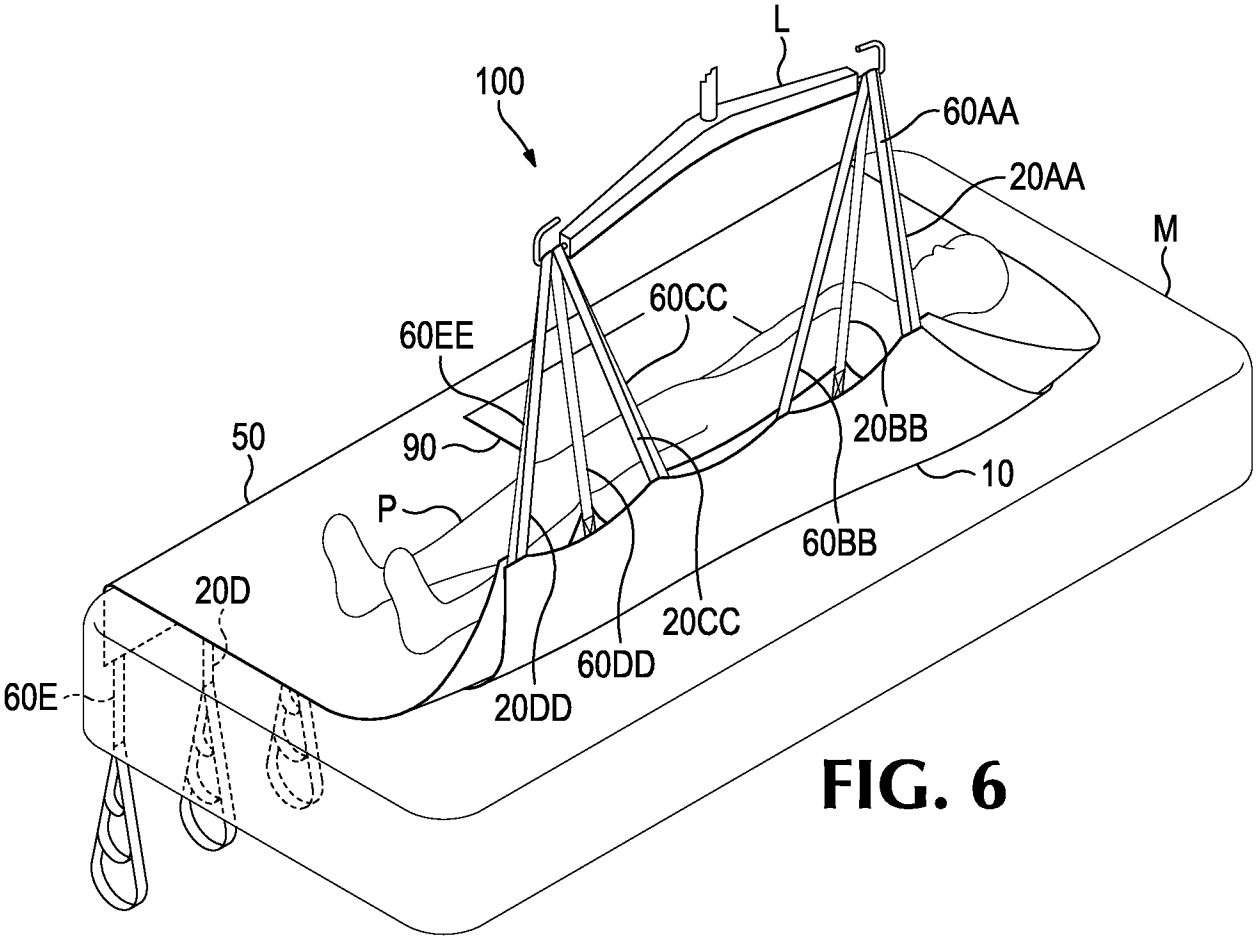
FIG. 6 is a top, front perspective view of an example of a body sling with patient handling sheets and a lift, according to embodiments of the invention.

In another example, and with continuing reference to FIGS. 6 and 7, the body sling 100 can be used to reposition the patient P. By following the procedure outlined above that is utilized to turn the patient P and gain access to the perineal area of the patient P, the lift can be operated to turn the patient to the side of choice. Pillows (not shown) are then propped under the opposite side of the patient to provide support.

From the foregoing description it will be apparent that modifications can be made to the body sling 100 without departing from the teachings of the invention.

The instant invention may be embodied in other forms or carried out in other ways without departing from the spirit or essential characteristics thereof. The present disclosure is therefore to be considered as in all respects illustrative and not restrictive, the scope of the invention being indicated by the appended claims, and all equivalency are intended to be embraced therein. One of ordinary skill in the art would be able to recognize equivalent embodiments of the instant invention and be able to practice such embodiments using the teaching of the instant disclosure and only routine experimentation.

What is claimed is:

1. A body sling to be used in combination with a patient lift, allowing a single caregiver to provide perineal care and skin integrity assessment to a bedridden patient, the body sling comprising: a bottom sheet having two longitudinal sides, the bottom sheet further comprising: a plurality of elongated bottom sheet lift straps, each lift strap attached to the bottom sheet at a proximal end of each strap; and, a plurality of bottom sheet lift loops, each lift loop configured to attach on a distal end of each of the bottom sheet lift straps; a top sheet having two longitudinal sides, the top sheet further comprising: a plurality of elongated top sheet lift straps, each lift strap attached to the top sheet at a proximal end of each strap; and, a plurality of top sheet lift loops, each lift loop configured to attach on a distal end of each of the top sheet lift straps; and, a cut-out in the shape of a rectangle positioned in the top sheet, providing a window and allowing access to a perineal area of the patient; wherein each bottom sheet lift strap is aligned to be between two adjacent top sheet lift straps.

2. The body sling of claim 1, wherein the bottom sheet straps are evenly spaced apart along each edge of each of the longitudinal sides of the bottom sheet.

3. The body sling of claim 2, wherein the bottom sheet includes eight bottom sheet lift straps, having four lift straps on each longitudinal side of the bottom sheet.

4. The body sling of claim 1, wherein the top sheet lift straps are evenly spaced apart along each edge of each of the longitudinal sides of the top sheet.

5. The body sling of claim 4, wherein the top sheet includes ten top sheet lift straps, having five lift straps on each longitudinal side of the top sheet.

6. The body sling of claim 3, wherein each bottom sheet lift strap terminates in a three lift loop configuration, resulting in three bottom sheet lift loops per strap.

7. The body sling of claim 5, wherein each top sheet lift strap terminates in a three lift loop configuration, resulting in three top sheet lift loops per strap.

8. The body sling of claim 1, wherein the suspension of the body sling from the lift may be adjustably positioned between more than one of the plurality of lift loops on each lift strap on each sheet.

9. The body sling of claim 1, wherein the top sheet and the bottom sheet each include at least a set of fabric fastening strips with a set on an underside of the top sheet for mating to a complimentary set on a topside of the bottom sheet, in order to prevent the top sheet and the bottom sheet from slipping out of alignment and configuration with one another.

10. The body sling of claim 1, wherein the top and bottom sheet lift straps are color-coded separately with the bottom sheet lift straps colored a different color than the top sheet lift straps to aid the caregiver in the alignment.

11. The body sling of claim 1, wherein one or more of the plurality of top and bottom sheet lift straps is loosely tied around itself and the lift for a quick release of the sheets.

12. The body sling of claim 1, wherein the patient is cocooned in the top sheet and bottom sheet while suspended from the lift.

13. The body sling of claim 1, wherein the patient is turned to one side or another through operation of the lift.

* * * * *